US011507024B2

(12) United States Patent
Mukaiyama

(10) Patent No.: US 11,507,024 B2
(45) Date of Patent: Nov. 22, 2022

(54) ELECTRONIC TIMEPIECE

(71) Applicant: Seiko Epson Corporation, Tokyo (JP)

(72) Inventor: Keiichi Mukaiyama, Matsumoto (JP)

(73) Assignee: SEIKO EPSON CORPORATION

( * ) Notice: Subject to any disclaimer, the term of this patent is extended or adjusted under 35 U.S.C. 154(b) by 963 days.

(21) Appl. No.: 16/266,323

(22) Filed: Feb. 4, 2019

(65) Prior Publication Data

US 2019/0243309 A1 Aug. 8, 2019

(30) Foreign Application Priority Data

Feb. 5, 2018 (JP) ..... JP2018-018554

(51) Int. Cl.

| | |
|---|---|
| ***G04B 43/00*** | (2006.01) |
| ***H05F 3/02*** | (2006.01) |
| ***G04B 3/04*** | (2006.01) |
| ***G04C 3/14*** | (2006.01) |

(52) U.S. Cl.

CPC ..... *G04B 43/00* (2013.01); *G04B 3/041* (2013.01); *G04C 3/14* (2013.01); *H05F 3/02* (2013.01)

(58) Field of Classification Search

CPC ..... G04B 43/00; G04B 43/002; G04B 3/041
See application file for complete search history.

(56) References Cited

U.S. PATENT DOCUMENTS

| | | | | |
|---|---|---|---|---|
| 5,644,553 | A * | 7/1997 | Cuinet | G04B 19/30 368/320 |
| 6,485,172 | B1 | 11/2002 | Takahashi et al. | |
| 2003/0231557 | A1 | 12/2003 | Nakajima et al. | |

FOREIGN PATENT DOCUMENTS

| | | | |
|---|---|---|---|
| CN | 1466022 | A | 1/2004 |
| GB | 2176319 | A | 12/1986 |
| JP | S61-281990 | A | 12/1986 |
| JP | S63-190987 | A | 8/1988 |
| JP | H05-232257 | A | 9/1993 |
| JP | H11-183645 | A | 7/1999 |
| JP | 2000-292560 | A | 10/2000 |
| JP | 2002-341061 | A | 11/2002 |
| JP | 2004-226236 | A | 8/2004 |
| JP | 2007-104146 | A | 4/2007 |
| JP | 2008-163607 | A | 7/2008 |

* cited by examiner

*Primary Examiner* — Edwin A. Leon
*Assistant Examiner* — Jason M Collins
(74) *Attorney, Agent, or Firm* — Harness, Dickey & Pierce, P.L.C.

(57) ABSTRACT

An electronic timepiece includes an exterior case; an electronic module housed in the exterior case; a winding stem projecting from the electronic module to the exterior case; and a conductive earth member having a plate-like portion and an elastic portion extending from the plate-like portion to a winding stem side, in which the winding stem has a flange disposed between the electronic module and the exterior case, and the elastic portion is brought into contact with a surface of the flange on an electronic module side in a state where the winding stem is pushed into the electronic module.

7 Claims, 6 Drawing Sheets

ELECTRONIC TIMEPIECE

BACKGROUND

1. Technical Field

The present invention relates to an electronic timepiece.

2. Related Art

An electronic timepiece is known to provide with a metallic part which induces static electricity from a winding stem to an exterior case so that static electricity intruding from a crown is induced to the movement via the winding stem, thereby preventing an electronic circuit from being influenced (for example, see JP-A-2000-292560).

In the electronic timepiece according to JP-A-2000-292560, a metallic circuit support is provided with a thin strip-shaped protrusion region which protrudes toward a back cover side of a winding stem and has spring properties. The protrusion region has a winding stem contact portion which is bent toward a dial side and is in contact with an outer peripheral surface of the winding stem. The protrusion region also has a back cover contact portion which is bent toward the back cover side in the winding stem contact portion and is in contact with a back cover. Consequently, even when static electricity intrudes from the crown to the winding stem, the static electricity can escape to the back cover via the winding stem contact portion and the back cover contact portion.

In the timepiece according to JP-A-2000-292560, the winding stem contact portion is pressed against and in contact with the outer peripheral surface of the winding stem by pressing down the back cover contact portion with the back cover. In order for the winding stem contact portion to be surely brought into contact with the winding stem and for rotation or pulling out of the winding stem not to be inhibited due to too large contact pressure, the protrusion region needs to be configured to be elastically deformed in a direction perpendicular to an axial direction of the winding stem. Accordingly, it is necessary to gently incline a sloped portion of the protrusion region with respect to a planar direction. Therefore, a large space for disposing the sloped portion is required at the winding stem on the back cover side, thus there is a problem that the electronic timepiece cannot be downsized.

SUMMARY

An advantage of some aspects of the invention is to provide an electronic timepiece which prevents an electronic circuit from being influenced by static electricity intruding from a crown and which can be downsized.

An electronic timepiece according to an aspect of the invention includes an exterior case having an exterior case body with an opening, and a back cover covering the opening; an electronic module housed in the exterior case; a winding stem projecting from the electronic module to the exterior case; and a conductive earth member having a plate-like portion and an elastic portion extending from the plate-like portion to the winding stem, in which the winding stem has a flange disposed between the electronic module and the exterior case, and the elastic portion is brought into contact with a surface of the flange on an electronic module side in a state where the winding stem is pushed into the electronic module.

According to the aspect of the invention, the elastic portion provided in a conductive grounding member is brought into contact with the surface of the flange on the electronic module side in a state where the winding stem is pushed into the electronic module. Consequently, the elastic portion is brought into contact with the flange in a state where the elastic portion is elastically deformed in an axial direction of the winding stem with respect to the flange, thus it is unnecessary to provide the elastic portion to be gently inclined with respect to a planar direction. For example, the elastic portion extending from a back cover side to a dial side is provided and is slightly inclined toward an outer circumference side of the timepiece, and thus the elastic portion can be brought into contact with the surface of the flange on the electronic module side. Therefore, the electronic timepiece can be downsized without necessity of providing a large space for disposing the elastic portion in the planar direction of the timepiece. Furthermore, the static electricity which has intruded from the crown to the winding stem can escape to a component functioning as a ground of the exterior case via the elastic portion, thus it is possible to prevent the electronic circuit from being influenced by the static electricity.

It is preferable that the elastic portion has an extending portion extending from the plate-like portion to the winding stem, and first and second abutting portions which are provided at a tip of the extending portion and in contact with the flange. It is also preferable that the winding stem is disposed between the first abutting portion and the second abutting portion.

According to the aspect of the invention with this configuration, the winding stem is disposed between the first abutting portion and the second abutting portion. Therefore, even when the timepiece is received an impact by falling of the like, motion of the elastic portion in a direction intersecting with the axial direction of the winding stem is restricted by the first abutting portion, the second abutting portion and the winding stem. Accordingly, it is possible to prevent the elastic portion from separating from the flange, and to release the static electricity which has intruded from the crown to the winding stem more reliably.

It is preferable that the electronic timepiece according to the aspect of the invention further includes a dial disposed in the outer case. It is also preferable that the electronic module is disposed between the dial and the back cover, the plate-like portion is disposed between the electronic module and the back cover, the extending portion extends from the plate-like portion to a dial side, the first and second abutting portions extend from a tip of the extending portion to the dial side, and tips of the first and second abutting portions are disposed closer to the dial side than a center of the axis of the winding stem.

According to the aspect of the invention with this configuration, the extending portion extends from the plate-like portion to the dial side. The first and second abutting portions extend from the tip of the extending portion toward the dial side, of which tips are disposed closer to the dial side than a center of the axis of the winding stem. Therefore, even when the timepiece is received an impact by falling of the like and the winding stem moves toward the dial side with respect to the elastic portion, the winding stem remains between the first abutting portion and the second abutting portion and thus does not get out of a space between the abutting portions as long as a moving amount of the winding stem is at least equal to or smaller than a radius of the winding stem. Accordingly, it is easy to maintain the contact state between the first and second abutting portions with the flange in a case where the elastic portion and the winding stem are relatively moved in a thickness direction of the timepiece. Consequently, it is possible to release the static electricity which has intruded from the crown to the winding stem more reliably.

It is preferable that the flange restricts motion of the winding stem in the axial direction.

According to the aspect of the invention with this configuration, the flange functions as a positioning portion of the winding stem to restrict motion of the winding stem in the axial direction. Therefore, it is easier to process the winding stem as compared with a case where the flange and the positioning portion are provided separately. Consequently, the production efficiency can be improved and the production cost can be reduced.

It is preferable that the elastic portion is separated from the flange in a state where the winding stem is pulled out from the electronic module.

According to the aspect of the invention with this configuration, the elastic portion is separated from the flange in a state where the winding stem is pulled out from the electronic module, that is, in a state where the crown is rotated. Whereby the elastic portion is not brought into contact with the flange upon rotating the crown, and thus the crown is smoothly operable. Moreover, the elastic portion does not need to be elastically and greatly deformed toward the electronic module side upon pushing the winding stem into the electronic module. Accordingly, it is possible to sufficiently reduce the elastic force applied on the flange from the elastic portion to the force required to pull out the winding stem, thereby preventing the winding stem from being falsely pulled out due to the elastic force of the elastic portion.

Furthermore, the user touches the crown in a state where the winding stem is pulled out, thus the static electricity which has intruded into the crown escapes to a user side. Therefore, the static electricity hardly intrudes into the electronic module via the winding stem even if the elastic portion is disposed away from the flange.

It is preferable that the conductive earth member is a circuit support disposed between the back cover and the electronic module. It is also preferable that the circuit support is provided with a conductive portion which conducts with the exterior case.

According to the aspect of the invention with this configuration, the conductive earth member is the circuit support which is provided with the conductive portion conducting with the exterior case. Thus, it is unnecessary to additionally provide a component for releasing the static electricity, guided from the elastic portion to the plate-like portion, to the exterior case, thereby decreasing types of the components. Consequently, the production efficiency can be improved and the production cost can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment will be described below with reference to the drawings.

Figure 1:
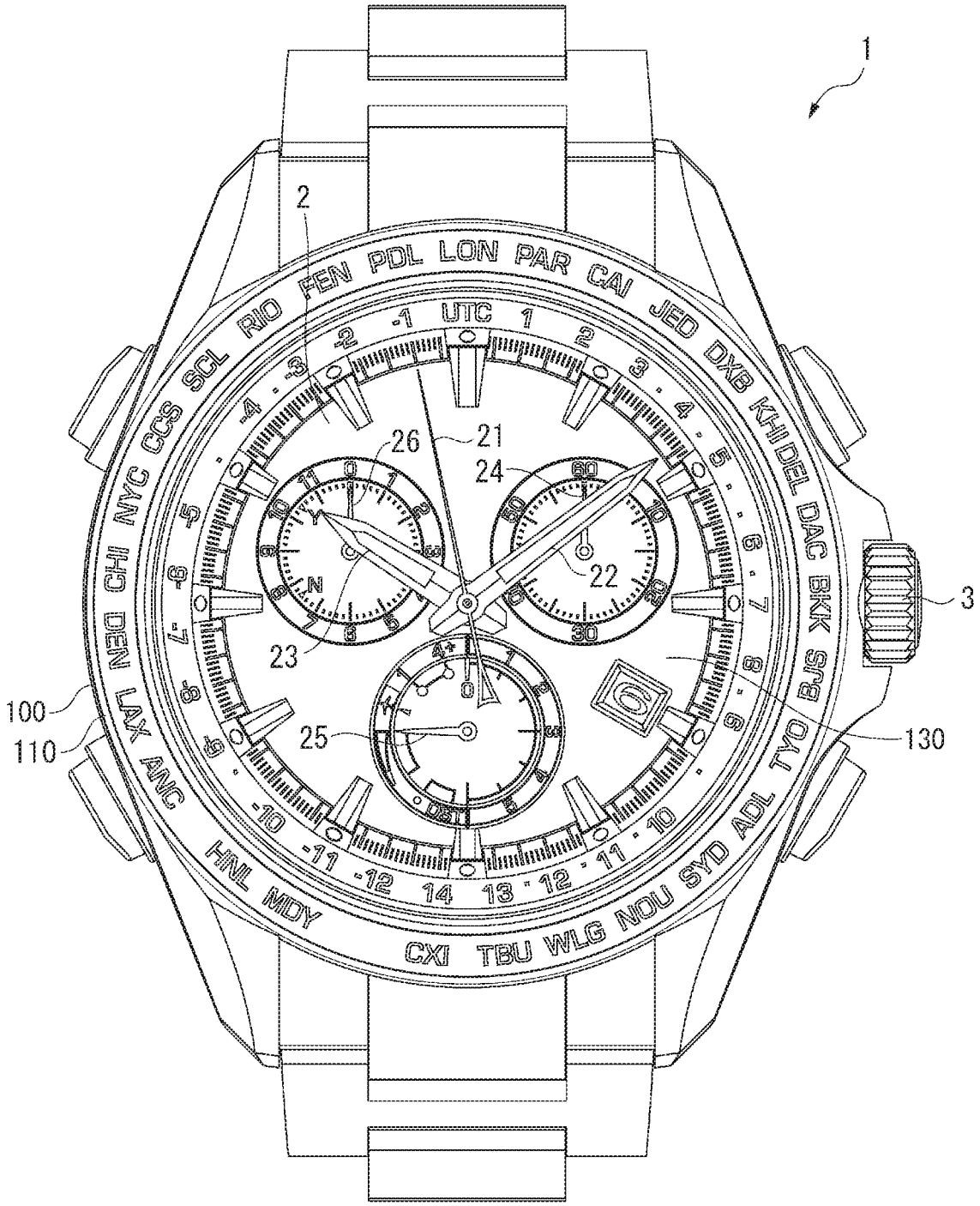
FIG. 1 is a front view illustrating an electronic timepiece according to one embodiment.
Figure 2:
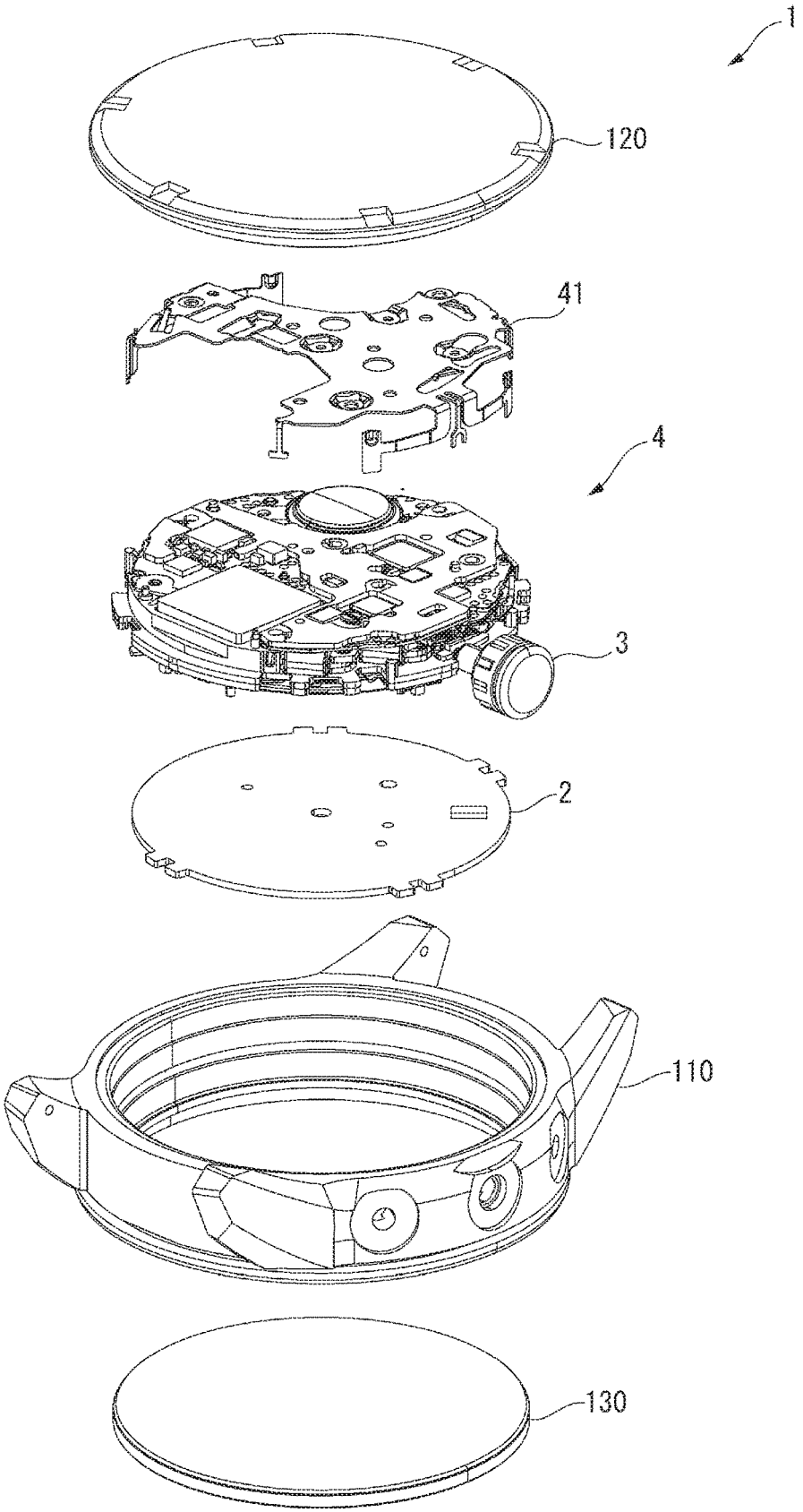
FIG. 2 is an exploded perspective view illustrating main parts of the electronic timepiece.
Figure 3:
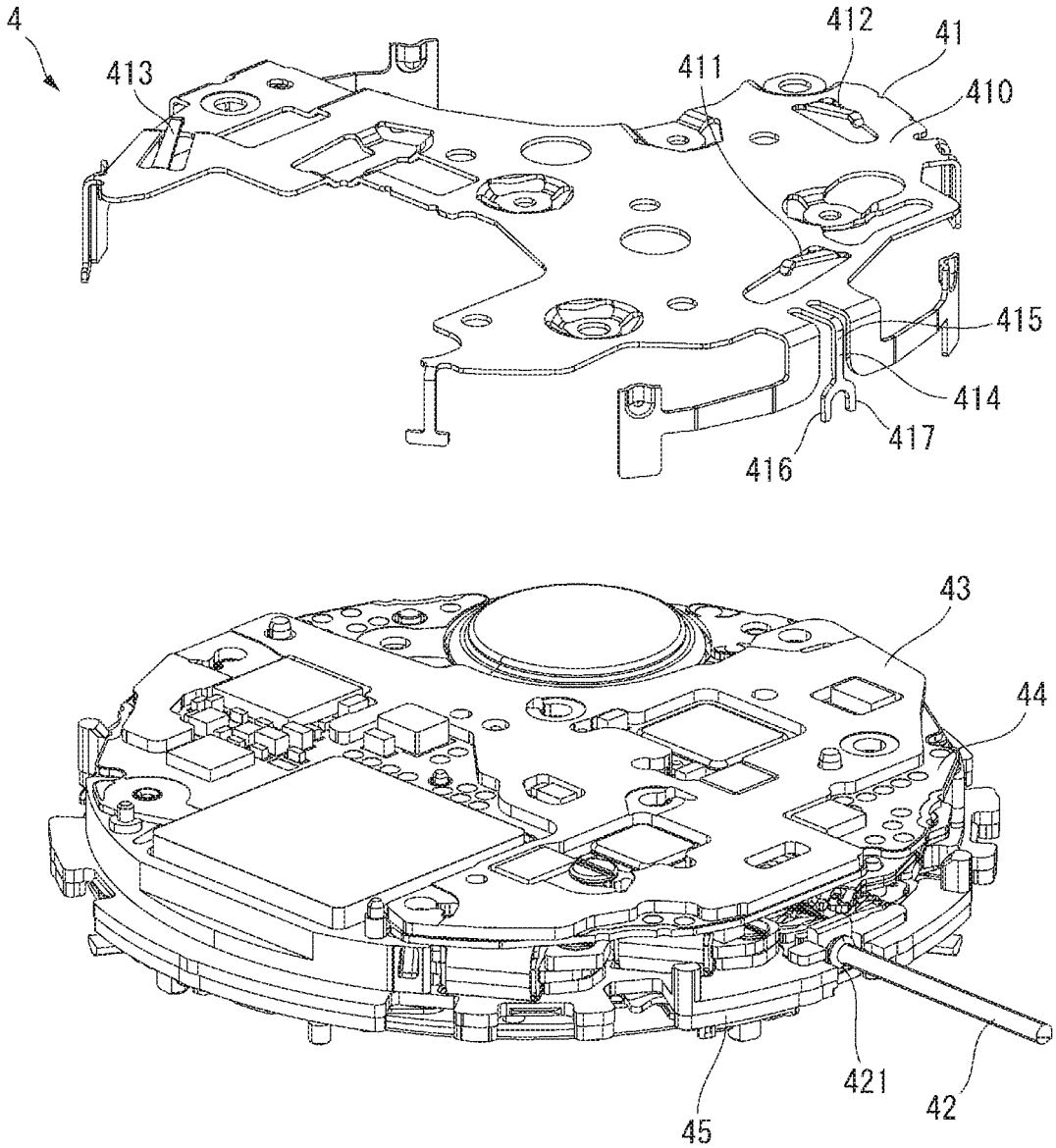
FIG. 3 is an exploded perspective view illustrating main parts of a movement of the electronic timepiece.

FIG. 1 is a front view of an electronic timepiece 1 according to one embodiment. FIG. 2 is an exploded perspective view of the electronic timepiece 1 facing down. FIG. 3 is an exploded perspective view illustrating main parts of a movement 4. In this embodiment, a side of a cover glass 130 will be referred to as a front side and a side of a back cover 120 will be referred to as a back side in the electronic timepiece 1.

Configuration of Electronic Timepiece

The electronic timepiece 1 is provided with an exterior case 100 formed of a conductive material, and an annular dial 2 is disposed on an inner circumferential side of the exterior case 100 as shown in FIGS. 1 and 2.

The exterior case 100 is provided with an exterior case body 110 formed in a substantially ring shape (tubular shape), and a back cover 120 which is a cover detachably attached to the back side of the exterior case body 110 and covering an opening of the exterior case body 110. Examples of the conductive material include metallic materials such as stainless steel, gold, titanium material or the like. A cover glass 130 is mounted on the front side of the exterior case body 110.

Furthermore, the exterior case body 110 is configured as a part different from the back cover 120 in this embodiment, but the invention is not limited to this configuration. The exterior case body 110 may be integrated with the back cover 120 as an integral case.

A crown 3 is provided on a side surface of the exterior case 100. By manipulating the crown 3, input according to the manipulation can be performed. The crown 3 can be pulled out in two steps from the normal position (zero position) where the crown 3 is pushed into toward a center of the electronic timepiece 1. A position where the crown 3 is pulled out up to a first step is referred to a first-step position and a position where the crown 3 is pulled out up to a second step is referred to a second-step position.

A dial 2 and a movement 4, which is one example of the electronic module, are housed in the exterior case 100, as shown in FIG. 2.

The dial 2 is made of a non-conductive material such as plastic, which is arranged on a side opposite to the back cover 120 with the movement 4 interposed therebetween. A second hand 21, a minute hand 22, an hour hand 23, and pointers 24, 25 and 26 indicating various information are arranged on the front side of the dial 2. Each of pointers 21 to 26 is attached to a pointer shaft of the movement 4 and is driven by the movement 4.

Configuration of Movement

A component which is conventionally used for the electronic timepieces can be adopted as the movement 4. In this embodiment, the movement 4 is a movement including a secondary battery that charges the power generated by the solar cell, a step motor driven by the electric power of the secondary battery, and a gear train driven by the step motor.

The movement 4 is provided with a circuit support 41, a magnetic resistant member 43, a circuit board 44, and a main plate 45 as shown in FIGS. 2 and 3. An electronic circuit or the like, for driving a step motor (not shown), is embedded into the printed circuit board 44.

Furthermore, the movement 4 is provided with a metallic winding stem 42 projecting from the movement 4 to the exterior case 100. A switching mechanism, such as a setting lever (not shown), is arranged around the winding stem 42.

Configuration of Winding Stem

Figure 4:
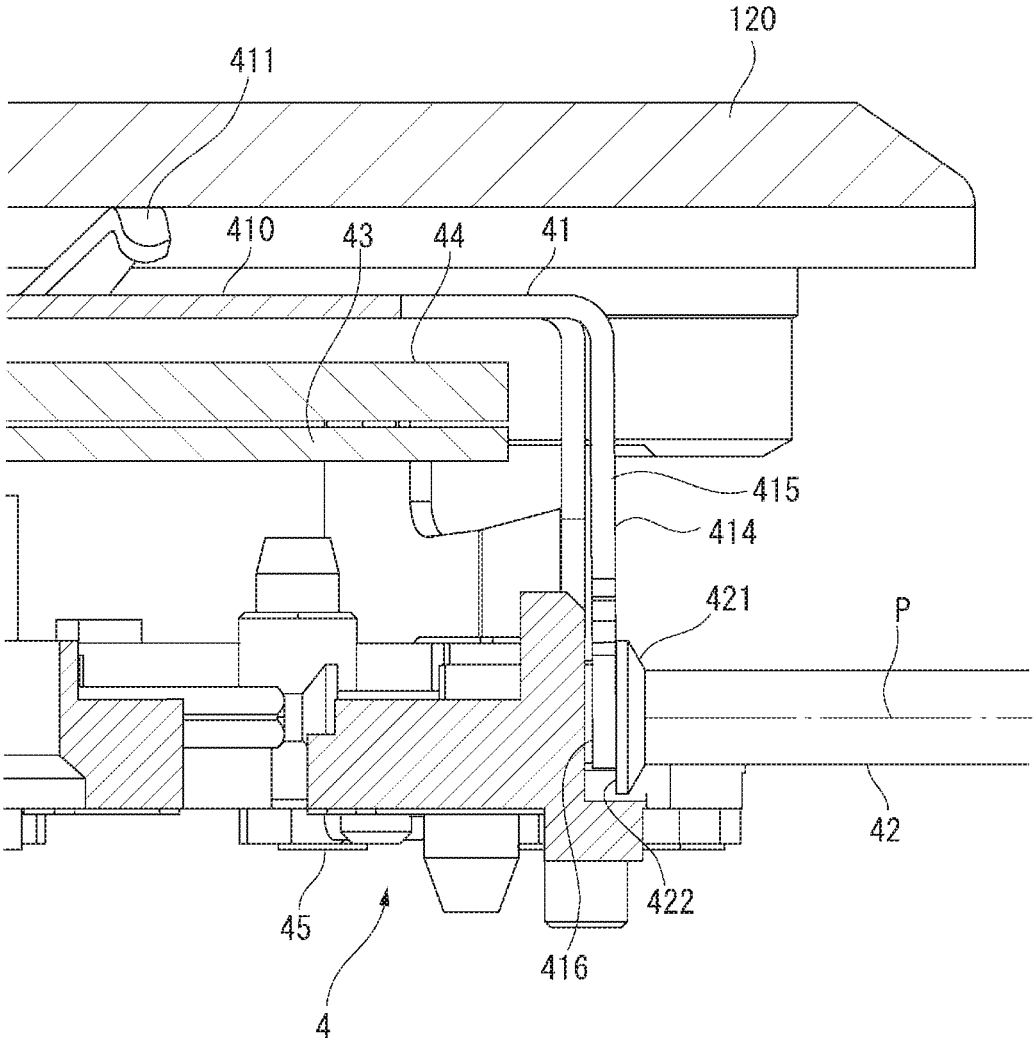
FIG. 4 is a schematic cross-sectional view illustrating main parts of the electronic timepiece in a state where a crown is at a zero position.

FIG. 4 is a schematic cross-sectional view of the vicinity of the winding stem 42 in a state where the crown 3 is at the zero position.

The crown 3 is attached to the winding stem 42 as shown in FIGS. 2 to 4, thus the winding stem 42 moves in the axial direction by pulling out the crown 3. That is, the winding stem 42 is normally positioned at the zero position, and moves to the first-step position or the second-step position by pulling out the crown 3.

Furthermore, the winding stem 42 is provided with a flange 421 arranged between the movement 4 and the exterior case 100. The flange 421 is formed so as to project in a direction perpendicular to the axis of the winding stem 42, in which a surface 422 on a side of the movement 4 is a plane perpendicular to the axis of the winding stem 42, and a surface on a side of the exterior case 100 is formed as a tapered surface. The flange 421 is brought into contact with the main plate 45 directly or via an elastic portion 414 when the winding stem 42 is pushed into toward a center of the electronic timepiece 1 by, for example, an impact on the electronic timepiece 1 due to the falling, and thus, the flange 421 restricts that the winding stem 42 moves beyond the zero position. That is, the flange 421 is one example of a positioning portion for restricting the motion of the winding stem 42 in the axial direction. Furthermore, the flange 421 is not limited to a shape of this embodiment. For example, the surface on the side of the exterior case 100 may be a flat surface instead of a tapered surface, or alternatively, the surface on the side of the movement 4 may be formed as the tapered surface. In particular, the surface on the side of the movement 4 is preferably in a shape capable of easily maintaining a contact state with the elastic portion 414 (described later).

Configuration of Circuit Support

The circuit support 41 is formed of a metal in a tabular shape. The circuit support 41 has a plate-like portion 410 which is arranged so as to cover the magnetic resistant member 43 and the printed circuit board 44, as shown in FIG. 3. Moreover, the circuit support 41 is provided with conductive portions 411 to 413, each of which functions as a metal spring bent so as to be inclined from the plate-like portion 410 toward the side of the back cover 120.

The circuit support 41 has an elastic portion 414 as a metal spring which is bent from an outer peripheral part of the plate-like portion 410 and extends toward the winding stem 42. The elastic portion 414 has an extending portion 415 extending from the plate-like portion 410 toward the winding stem 42, and a first abutting portion 416 and a second abutting portion 417, which are continuous to a tip side of the extending portion 415 and formed in bifurcated and in a U-shape.

Figure 5:
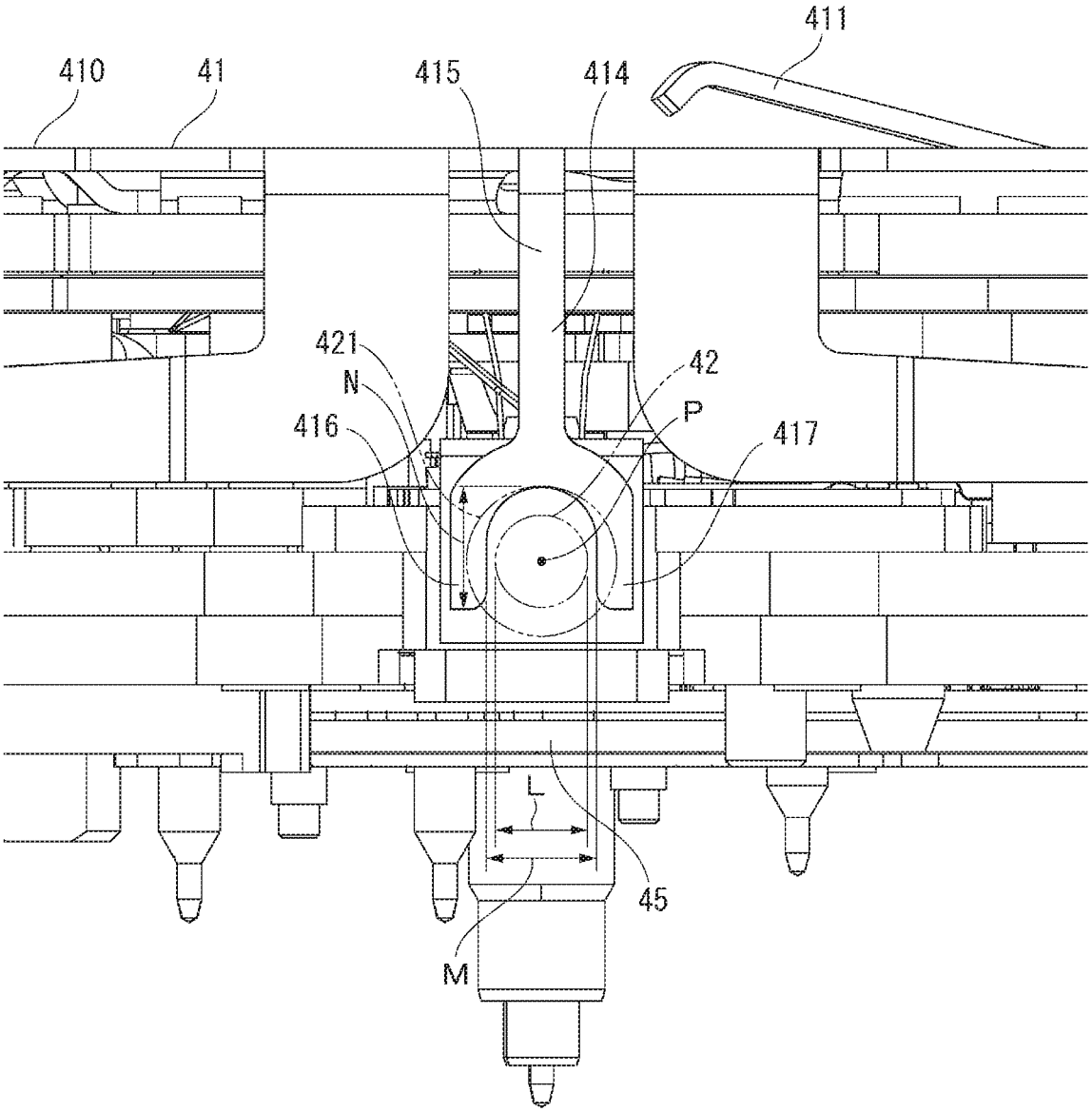
FIG. 5 is a schematic front view illustrating main parts of the electronic timepiece in the state where the crown is at the zero position.

FIG. 5 is a schematic front view of the vicinity of the winding stem 42 in a state where the crown 3 is at the zero position.

The extending portion 415 extends from the plate-like portion 410 toward a side of the dial 2, that is, the front side of the electronic timepiece 1, as shown in FIGS. 4 and 5.

The first abutting portion 416 and the second abutting portion 417 are formed so that a width M of a groove formed in a U-shape on an inner side is larger than a diameter L of the winding stem 42. The winding stem 42 is arranged between the first abutting portion 416 and the second abutting portion 417. Therefore, the first abutting portion 416 and the second abutting portion 417 are not brought into direct contact with an outer peripheral surface of the winding stem 42.

Furthermore, the first abutting portion 416 and the second abutting portion 417 extend from the tip side of the extending portion 415 to the side of the dial 2. At this time, the first abutting portion 416 and the second abutting portion 417 are formed so that a depth N of the groove formed in a U-shape on the inner side is larger than the diameter L of the winding stem 42, of which tips are disposed closer to the dial side than a cross-sectional center (center of the shaft) P of the winding stem 42.

The first abutting portion 416 and the second abutting portion 417 are brought into contact with the surface 422 of the flange 421 on the side of the movement 4 in a state where the crown 3 is at the zero position, that is, the winding stem 42 is pushed into the movement 4, as shown in FIG. 4. The conductive portions 411 to 413 are brought into contact with the back cover 120 in order to electrically connect the circuit support 41 to the back cover 120.

Consequently, the static electricity which has intruded from the crown 3 to the winding stem 42 can escape to the back cover 120 via the elastic portion 414, the plate-like portion 410, and the conductive portions 411 to 413. That is, in this embodiment, the circuit support 41 is one example of a conductive earth member.

In this embodiment, the elastic portion 414 is brought into contact with the surface 422 of the flange 421, thus the elastic portion 414 is brought into contact with the surface 422 in a state of being elastically deformed in the axial direction of the winding stem 42. Therefore, it is unnecessary to provide the elastic portion 414 to be gently inclined with respect to the planar direction. In this embodiment, the elastic portion 414 is provided such that its base end side is bent at an angle of about 90 degrees with respect to the plate-like portion 410.

Figure 6:
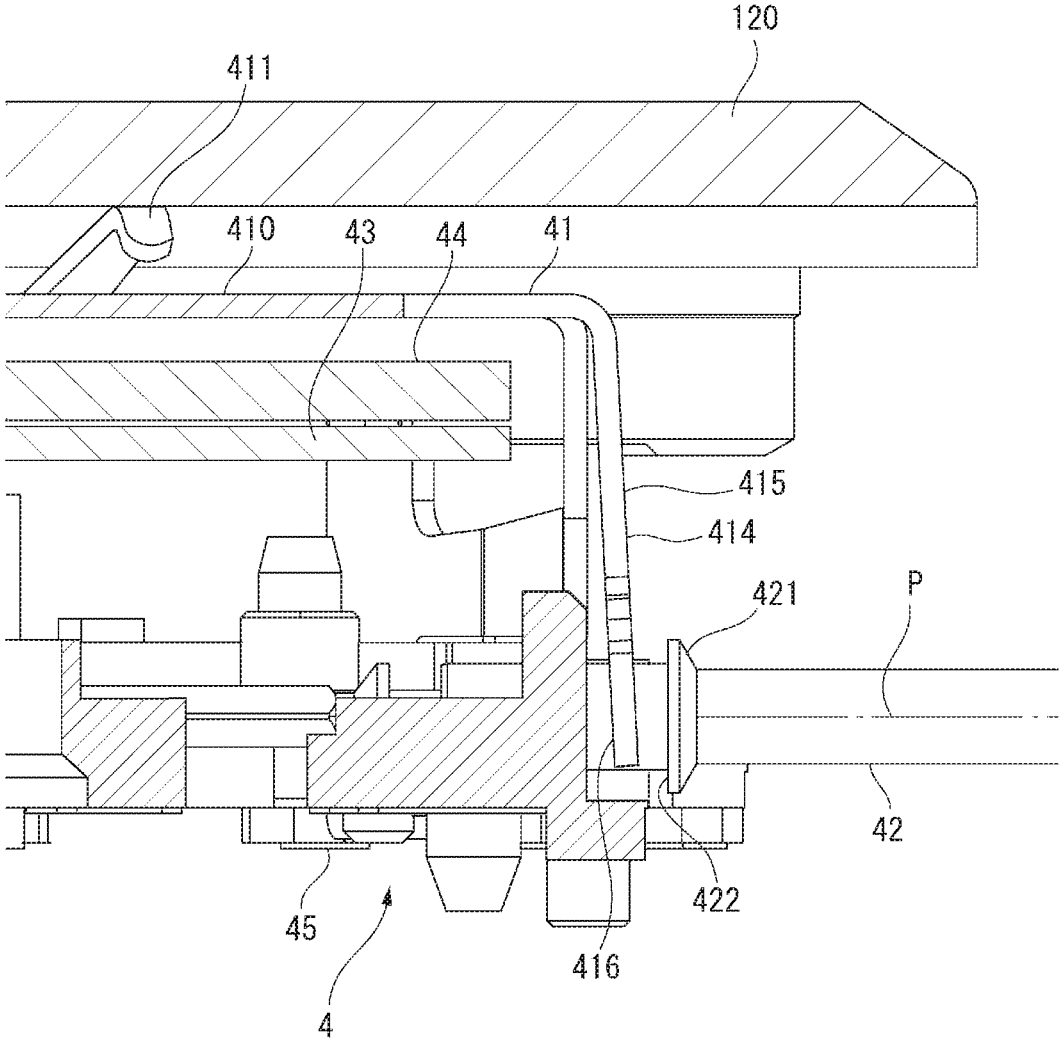
FIG. 6 is a schematic cross-sectional view illustrating main parts of the electronic timepiece in a state where the crown is at a first-step position.

FIG. 6 is a schematic cross-sectional view of the vicinity of the winding stem 42 in a state where the crown 3 is at the first-step position.

The first abutting portion 416 and the second abutting portion 417 are separated from the flange 421 in a state where the crown 3 is at the first-step position, that is, the winding stem 42 is pulled out from the movement 4, as shown in FIG. 6. Therefore, the flange 421 is not brought into contact with the first abutting portion 416 and the second abutting portion 417 when rotating the crown 3 at the first-step position.

As a matter of course, in a state where the crown 3 is at the second-step position, the first abutting portion 416 and the second abutting portion 417 are separated from the flange 421.

Furthermore, the first abutting portion 416 and the second abutting portion 417 are separated from the flange 421 in a state where the crown 3 is at the first-step position, thus the elastic portion 414 does not need to be elastically and greatly deformed toward the side of the movement 4 along the axial direction of the winding stem 42 upon pushing the crown 3 into the zero position as shown in FIG. 4. That is, the elastic portion 414 is brought into contact with the flange 421 in a state of being elastically deformed toward the side of the movement 4 in a state where the crown 3 is at the zero position. In this state, the elastic force applied on the flange 421 is sufficiently smaller than the force required to pull out the crown 3 to the first-step position or the second-step position.

The user usually touches the crown 3 in a state where the winding stem 42 is pulled out, thus the static electricity which has intruded into the crown 3 escapes to a user side. Therefore, the static electricity hardly intrudes into the movement 4 via the winding stem 42 even if the elastic portion 414 is disposed away from the flange 421.

Advantageous Effects of Embodiment

According to the embodiment as stated above, the following advantageous effects can be obtained.

In this embodiment, the elastic portion 414 is brought into contact with the surface 422 of the flange 421 in a state where the winding stem 42 is pushed into the movement 4. Consequently, the elastic portion 414 is brought into contact with the flange 421 in a state of being elastically deformed with respect to the axial direction of the winding stem 42, thus it is unnecessary to provide the elastic portion 414 to be gently inclined with respect to the planar direction. Therefore, the electronic timepiece 1 can be downsized without necessity of providing a large space for disposing the elastic portion 414 in the winding stem 42 on the side of the back cover 120. Furthermore, the static electricity which has intruded from the crown 3 to the winding stem 42 can escape to the back cover 120 of the exterior case 100 via the elastic portion 414, the plate-like portion 410, and the conductive portions 411 to 413, thus it is possible to prevent the electronic circuit from being influenced by the static electricity.

In this embodiment, the first abutting portion 416 and the second abutting portion 417, in contact with the flange 421, are formed so that the width M of the groove formed in a U-shape on the inner side is larger than the diameter L of the winding stem 42. The winding stem 42 is arranged between the first abutting portion 416 and the second abutting portion 417. Therefore, even when the electronic timepiece 1 is received an impact by falling of the like, motion of the elastic portion 414 in a direction intersecting with the axial direction of the winding stem 72 is restricted by the first abutting portion 416, the second abutting portion 417 and the winding stem 42. Accordingly, it is possible to prevent the elastic portion 414 from separating from the flange 421, and to release the static electricity which has intruded from the crown 3 to the winding stem 42 more reliably.

Furthermore, the first abutting portion 416 and the second abutting portion 417 are not brought into direct contact with the outer peripheral surface of the winding stem 42, thus the winding stem 42 is smoothly pulled out without a risk of being stuck with the outer peripheral surface of the winding stem 42.

In this embodiment, the first abutting portion 416 and the second abutting portion 417 extend from the tip of the extending portion 415 to the side of the dial 2. At this time, the first abutting portion 416 and the second abutting portion 417 are formed so that the depth N of the groove formed in a U-shape on the inner side is larger than the diameter L of the winding stem 42, in which tips of the first abutting portion 416 and the second abutting portion 417 are disposed closer to the dial side than a cross-sectional center P of the winding stem 42. Therefore, even when the timepiece 1 is received an impact by falling of the like and the winding stem 42 moves toward the side of the dial 2 with respect to the elastic portion 414, the winding stem 42 remains between the first abutting portion 416 and the second abutting portion 417 and thus does not get out of a space between the abutting portions as long as a moving amount of the winding stem 42 is at least equal to or smaller than a radius of the winding stem 42. Accordingly, it is easy to maintain the contact state between the first abutting portion 416 and the second abutting portion 417 with the flange 421 in a case where the elastic portion 414 and the winding stem 42 are relatively moved in the thickness direction of the timepiece. Consequently, it is possible to release the static electricity which has intruded from the crown 3 to the winding stem 42 more reliably.

In this embodiment, the flange 421 functions as a positioning portion of the winding stem 42 to restrict motion of the winding stem 42 in the axial direction. Therefore, it is easier to process the winding stem 42 as compared with a case where the flange 421 and the positioning portion are provided separately. Consequently, the production efficiency can be improved and the production cost can be reduced.

In this embodiment, the elastic portion 414 is separated from the flange 421 in a state where the winding stem 42 is pulled out from the movement 4, that is, in a state where the crown 3 is rotated. Whereby the elastic portion 414 is not brought into contact with the flange 421 upon rotating the crown 3, and thus the crown 3 is smoothly operable. Moreover, the elastic portion 414 does not need to be elastically and greatly deformed toward the side of the movement 4 upon pushing the winding stem 42 into the movement 4. Accordingly, it is possible to sufficiently reduce the elastic force applied on the flange 421 from the elastic portion 414 to the force required to pull out the winding stem 42, thereby preventing the winding stem 42 from being falsely pulled out due to the elastic force of the elastic portion 414.

In this embodiment, the circuit support 41 is provided with conductive portions 411 to 413 conducting with the back cover 120 of the exterior case 100. Thus, it is unnecessary to additionally provide a component for releasing the static electricity, guided from the elastic portion 414 to the plate-like portion 410, to the exterior case 100, thereby decreasing types of the components. Consequently, the production efficiency can be improved and the production cost can be reduced.

Other Embodiments

It should be noted that the invention is not limited to the embodiment stated above, and variations, improvements and the like are encompassed in the invention in a range where the objects of the invention are achieved.

In the embodiment stated above, the circuit support 41 is provided with conductive portions 411 to 413 conducting with the back cover 120. However, a separate component may be provided to release the static electricity to the exterior case; but in this case, types of the components increase, thus it is preferable that the circuit support 41 is provided with conductive portions 411 to 413.

The conductive portions 411 to 413 are provided so as to bring into contact with the back cover 120. However, the conductive portions 411 to 413 may be provided so as to bring into contact with a component functioning as the ground, for example, so as to bring into contact with a case body of the exterior case.

In the embodiment stated above, the first abutting portion 416 and the second abutting portion 417 are continuous to a tip side of the extending portion 415 and formed in bifurcated and in a U-shape. However, for example, two thin plate-shaped elastic portions may be bent from the plate-like portion, respectively, and the first abutting portion and the second abutting portion may be provided. Furthermore, the elastic portion may be provided so as to be in contact with the flange. For example, the elastic portion may be provided in a ring shape so that the tip end surrounds the winding stem.

In the embodiment stated above, the flange 421 functions as the positioning portion for restricting a position of the winding stem 42 in the axial direction, but the flange and the positioning portion may be provided separately. However, in this case, it is difficult to process the winding stem 42, thus it is preferable that the flange functions as the positioning portion.

In the embodiment state above, the first abutting portion 416 and the second abutting portion 417 are configured to separate away from the flange 421 in a state where the crown 3 is at the first-step position, that is, in a state where the winding stem 42 is pulled out from the movement 4. However, the elastic portion and the flange may be brought into contact with each other in a state where the crown 3 is at the first-step position or the second-step position.

The electronic module according to the invention is not limited to a movement having a step motor for driving pointers, and may be an electronic module for driving a display unit such as a liquid crystal panel or an organic EL panel.

The entire disclosure of Japanese Patent Application No. 2018-018554, filed Feb. 5, 2018 is expressly incorporated by reference herein.

What is claimed is:

1. An electronic timepiece comprising:

an exterior case having an exterior case body with an opening, and a back cover covering the opening;

an electronic module housed in the exterior case;

a winding stem projecting from the electronic module to the exterior case; and a conductive earth member having a plate portion and an elastic portion extending from the plate portion to the winding stem, wherein the winding stem has a flange disposed between the electronic module and the exterior case, and the elastic portion is configured to contact with a surface of the flange on an electronic module side in a state where the winding stem is pushed into the electronic module, wherein the elastic portion has an extending portion extending from the plate portion to the winding stem, and first and second abutting portions which are provided at a tip of the extending portion and configured to contact with the flange in the state where the winding step is pushed into the electronic module, and the winding stem is disposed between the first abutting portion and the second abutting portion such that the first abutting portion and the second abutting portion do not contact an outer peripheral surface of the winding stem.

2. The electronic timepiece according to claim 1, wherein the flange has a shape projecting in a direction perpendicular to an axis of the winding stem, and the surface on the electronic module side is a plane.

3. The electronic timepiece according to claim 1, wherein the elastic portion has an extending portion extending from the plate portion to the winding stem, and first and second abutting portions which are provided at a tip of the extending portion and in contact with the flange, and the winding stem is disposed between the first abutting portion and the second abutting portion.

4. The electronic timepiece according to claim 3, further comprising:

a dial disposed in the outer case, wherein the electronic module is disposed between the dial and the back cover, the plate portion is disposed between the electronic module and the back cover, the extending portion extends from the plate portion to a dial side, and the first and second abutting portions extend from a tip of the extending portion to the dial side, and tips of the first and second abutting portions are disposed closer to the dial side than a center of the axis of the winding stem.

5. The electronic timepiece according to claim 1, wherein the flange restricts motion of the winding stem in an axial direction.

6. The electronic timepiece according to claim 1, wherein the elastic portion is separated from the flange in a state where the winding stem is pulled out from the electronic module.

7. The electronic timepiece according to claim 1, wherein the conductive earth member is a circuit support disposed between the back cover and the electronic module, and the circuit support is provided with a conductive portion which conducts with the exterior case.

* * * * *